United States Patent [19]

Sundberg

[11] 4,265,439

[45] May 5, 1981

[54] METHOD AND APPARATUS FOR FOLDING A TUBULAR LENGTH OF HOSE MATERIAL TO FORM A PACKAGE

[75] Inventor: Sture Sundberg, Malmö, Sweden

[73] Assignee: Aktiebolaget Platmanufaktur, Malmö, Sweden

[21] Appl. No.: 907,956

[22] Filed: May 22, 1978

Related U.S. Application Data

[62] Division of Ser. No. 776,652, Mar. 11, 1977, Pat. No. 4,134,892.

[51] Int. Cl.[3] ..... B65H 45/20

[52] U.S. Cl. ..... 493/451; 270/39; 493/940

[58] Field of Search ..... 270/79, 61 R, 68 R; 206/303; 53/529; 93/84 TW

[56] References Cited

U.S. PATENT DOCUMENTS

| | | | |
|---|---|---|---|
| 2,497,786 | 2/1950 | Miller | 270/79 |
| 2,855,830 | 10/1958 | Rowland | 270/79 |
| 3,279,784 | 10/1966 | Schwendinger | 270/79 |
| 4,106,398 | 8/1978 | Buisson | 93/84 TW |

*Primary Examiner*—Edgar S. Burr
*Assistant Examiner*—A. Heinz
*Attorney, Agent, or Firm*—Hane, Roberts, Spiecens & Cohen

[57] ABSTRACT

A method and apparatus for folding a tubular length of hose material to form a package with superposed layers comprising feeding an axial length of material past a pulling device onto a retaining guide, clamping the material against the guide and axially displacing the pulling device to pull a further length of material and fold the same onto the first length of material clamped to the guide. The clamping action on the material is then released and the retainer guide is withdrawn and positioned adjacent the now folded material. The pulling device is withdrawn from the fold by axially displacing the same in reverse direction to its original position and the steps are repeated to form successive folds of material to constitute the superposed layers of the package.

13 Claims, 31 Drawing Figures

METHOD AND APPARATUS FOR FOLDING A TUBULAR LENGTH OF HOSE MATERIAL TO FORM A PACKAGE

This is a divisional of application Ser. No. 776,652 filed Mar. 11, 1977 now U.S. Pat. No. 4,134,892.

FIELD OF THE INVENTION

The present invention relates to methods and apparatus for the manufacture of a package made of a flexible material which is mainly made up of a hose of any diameter, where the wall of the hose in the package is embedded as folds placed one over the other seen from the center line of the package.

A package according to the invention will look like a more or less regular star or toothed wheel with radially embedded folds so that the hose forms axial wall elements.

PRIOR ART

According to known technology, a hose of the type mentioned can be embedded in a package by means of radial winding in overlapping layers as described in the Swedish Patent published application No. 7116859-5. In this way a relatively compact hose package is obtained, which entails that a long hose can be embedded within a small volume.

When the hose is unfolded from such a package a relative torsional movement is required, however, between the package and the unfolded hose, and a special arrangement may be necessary in order to accomplish this movement. In order to eliminate drawbacks of this type, a hose has even been stored, according to known technology, in such a way that it is led onto a pin, where it formed a mainly torus-shaped package through irregular folding and shirring.

Hoses embedded in such a way that the least possible space is needed for the storage are desirable for various applications such as packing of goods, for instance in connection with handling of waste.

SUMMARY OF THE INVENTION

The present invention contemplates a method and apparatus for the manufacture of a package made up of a flexible material which contains a sufficient quantity of hose to facilitate rational usage in connection with many applications. From the package the hose can be pulled out or unfolded without a relative torsional movement between the removed hose and the package. The package is compact and the hose can be pulled out of the package mainly by an axial movement of the hose in relation to the package or vice versa.

According to the invention the packed hose can be pulled out, starting either from the outer limiting line of the package or from the inner limiting line of the package. The package can also be arranged in such a way that when the hose is pulled out of the package an opening is formed for filling of goods into the part of the hose which has been pulled out.

The package is characterized by the fact that a predetermined length of one end of the hose, in the longitudinal directon of the hose, forms an outer mantle surface of the package, and a predetermined length of the other end of the hose forms an inner mantle surface of the package. The mantle surfaces of the package formed in this way are thus principally of the same height. The part of the hose in between is embedded as a number of folds placed next to each other between the mantle surfaces and mainly parallel with these and principally with the same height as the mantle surfaces of the hose package. The folds or wall elements formed are thus oriented axially in the package. The shape of the package partly depends upon the arrangement of the manufacture of the package. The inner mantle surface can, for instance, have the general shape of a four-point star. All of the folds situated outside each other are of the same circumference or length of material as the inner mantle surface, and when they are embedded in the package they are stretched over the points of the star, and therefore the folds lie fully true against each other at the corners of the star.

In this way the outer mantle surface will assume a shape which is substantially square. For the same reason the outer mantle surface will become a triangle if the inner mantle surface forms a three-point star. If the inner mantle surface is a regular polygon, for instance an octagon, the outer mantle surface is substantially circular. The shape of the hose package will be illustrated by another example:

If we presume that the outer mantle surface has a shape which is like a pentagon, each fold has a circumference which is of the same size as the circumference of the outer mantle surface, and therefore each fold in the radial direction towards the center has an increasingly irregular shape. In the previous paragraph the shape and structure of a hose package has been discussed, both on the basis of a presumed shape of the inner mantle surface of the hose package and on the basis of a presumed shape of the outer mantle surface of the hose package. No matter whether the shape and structure of the hose package have been discussed on the basis of the inner or the outer mantle surface it applies to each hose package that there are an outer and an inner mantle surface. The shape of the mentioned mantle surfaces with the folds in between depend as mentioned upon the manner of manufacture. The hose package is formed by means of successive folding, and the folding can be started in connecton with either the inner mantle surface or the outer mantle surface. We presume that the folding is started so that the outer mantle surface is first formed and with a shape which is that of a four-point star. When each fold has been formed, all of the folds are led in the radial direction outwards when the next fold is to be formed so that the already made folds are to some extent stretched successively. As each fold has the same length of material corresponding to the circumference of the hose this will lead to the final shape of the outer limiting line of the hose package, viz. almost that of a quadrangle. If, on the other hand, the folding is made so that the inner mantle surface is formed first, each of the following folds is going to make the previously laid fold take up a successively smaller area, and therefore the folds will get an increasingly irregular shape in the radial direction towards the center. The wall of the hose in each wall is almost always stretched.

DETAILED DESCRIPTION

Figure 1:
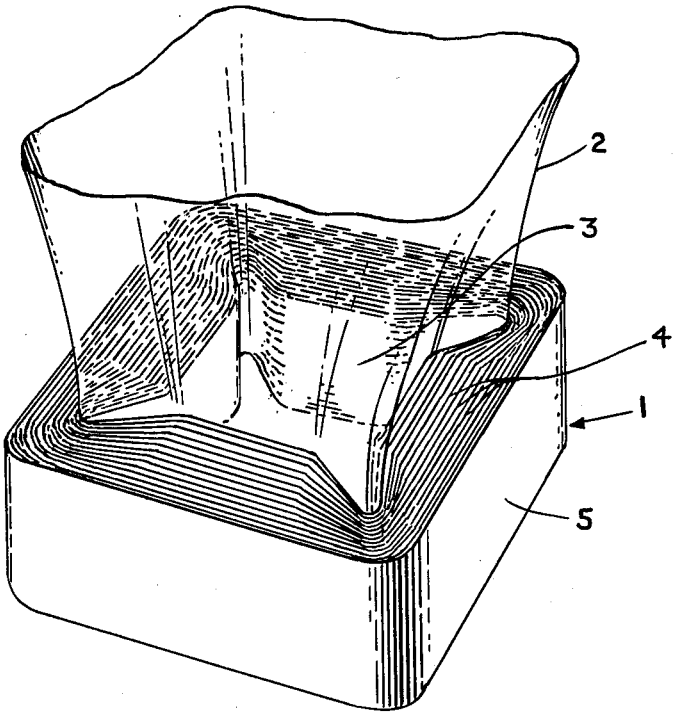
FIG. 1 shows in perspective an embodiment of the hose package.
Figure 2:
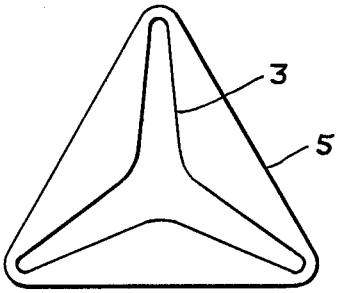
FIGS. 2–13 show examples of the geometry of embodiments of various the hose package, FIGS. 14–25 step by step and schematically show a principle of the manufacture of the hose package.
Figure 3:
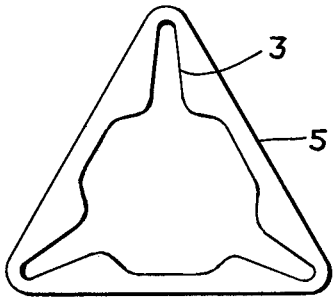

FIG. 1 shows an embodiment of a hose package 1 with an inner mantle surface 3 and and outer mantle surface 5, where part of the hose 2 is situated outside the hose package. The mantle surface 3 has the shape of a four-point star. It appears from the figure that the hose in the hose package is embedded in a number of folds 4, oriented mainly parallel with the mantle surfaces and situated between these. As each fold is made up of a hose which in the outwards direction of its whole length has the same circumference, the folds situated outside the inner mantle surface are successively stretched more and more. It is intended that the material in each fold is mainly even and plane but that it forms large or small inwards directed bends, depending upon where the fold is situated in relation to the mantle surfaces. The result of this is that the extreme fold, which forms the outer mantle surface 5, is mainly of a rectangular shape.

The FIGS. 2–13 show examples of various embodiments of the hose package 1. In the figures, there are only shown the inner and outer mantle surfaces of the hose package. The embodiments according to FIGS. 2–9 are appropriate when the hose package is formed through successive folding in such a way that the outer mantle surface 5 is formed first and so that the folds are formed in the direction from the hose package, i.e. each new additional fold at the formation of the hose package is laid inside the previous fold. If the folding is performed in the opposite direction, so that the inner mantle surface 3 is formed first, the embodiments according to the FIGS. 10–13 are more suitable.

The FIGS. 14–25 show in a schematic way a method for the manufacture of the hose package and a device in principle for this purpose. A locking device 10, a retaining device 11, and a pulling device 12 form in co-ordination a radially arranged fold 4 with axial wall elements. The retaining device 11 has a shape which depends upon the embodiment preferred for the hose package 1. When the hose package is formed by folding from the inside, the shape of the retaining device 11 is associated with the shape of the inner mantle surface 3, and when the folding is performed from the outside, it is associated with the shape of the outer mantle surface 5.

Figure 14:
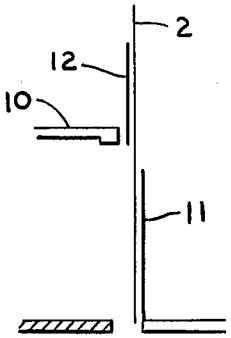
Figure 15:
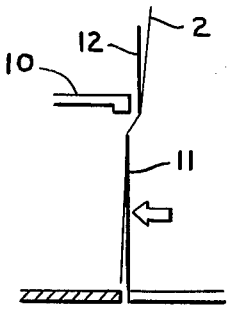
Figure 16:
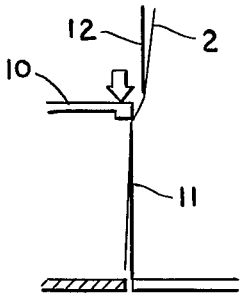
Figure 17:
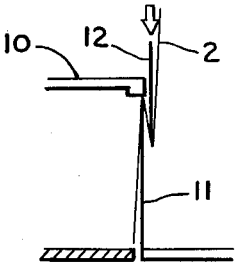
Figure 18:
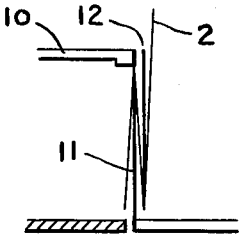
Figure 19:
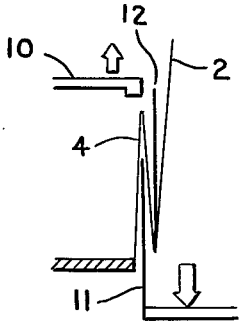
Figure 20:
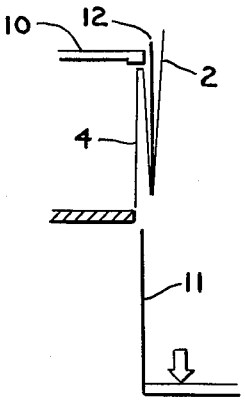
Figure 21:
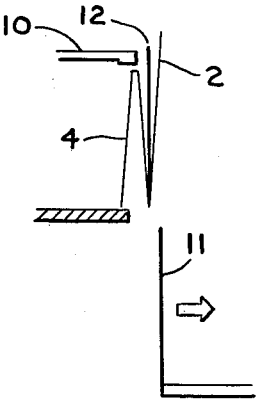
Figure 22:
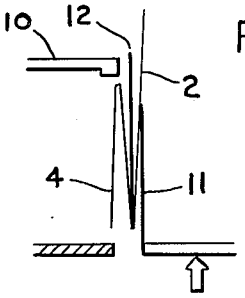
Figure 23:
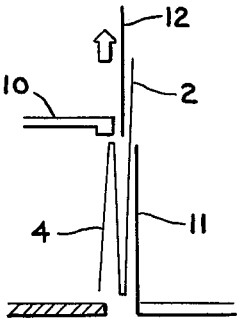
Figure 24:
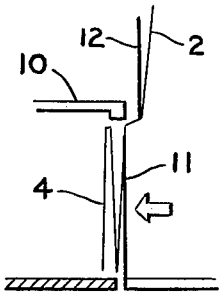
Figure 25:
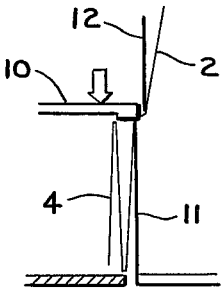

In the described embodiment of the device for manufacture of the hose package the retaining device 11 is divided into sections and arranged so that each section can be moved in two directions which are at right angles to each other. In connection with FIGS. 14–25 the function is explained step by step. In FIG. 14 the free end of the hose 2 has been pulled over the retaining device 11. In FIG. 15 the retaining device 11 has been moved one step in the direction towards the side of the hose to a position for retaining. In FIG. 16 the hose is pressed by the locking device 10 against the retaining device 11. In FIGS. 17 and 18 the pulling device 12 feeds a length of hose in such a way that a fold is formed in the hose package which is being manufactured. In FIGS. 19 and 20 the locking device 10 and the retaining device 11 are removed from the fold formed. In FIG. 21 the retaining device 11 has made a stepwise movement so that it can be moved, as shown if FIG. 22, to the same position as in FIG. 14. In FIG. 23 the pulling device 12 has returned to the position it had in FIG. 14. In FIG. 24 the retaining device 11 has been moved one step to the position for retaining, and thus the already laid folds have even been moved. In FIG. 25 the hose is pressed by the locking device 10 against the retaining device 11, and then the pulling device 12 starts its movement for the formation of another fold. The operations described are repeated until a predetermined number of folds have been obtained, and then the formed hose package is separated from the hose supply.

Figure 26:
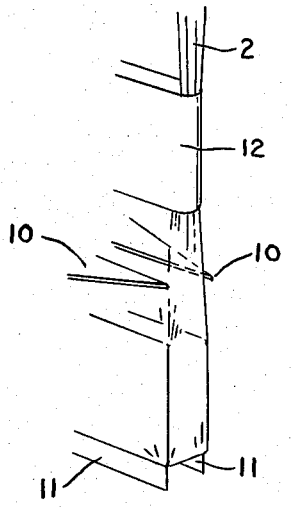
FIGS. 26–29 show in perspective some elements according to the FIGS. 14–24.
Figure 27:
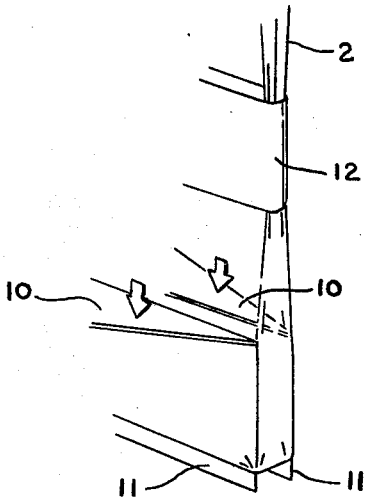
Figure 28:
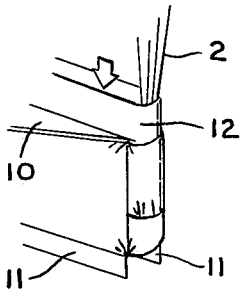
Figure 29:
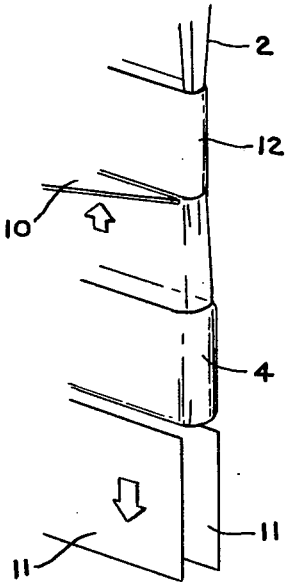

FIGS. 26–29 show in perspective some of the factors in connection with the manufacture of the hose package according to the invention. FIG. 26 corresponds to FIG. 15, and it shows how the hose 2 runs inside the illustrated part of the pulling device 12. It is also shown how two locking devices 10 take up a position which results in the fact that the hose can relatively freely be placed so that it surrounds the two parts of the retaining device 11 shown in the figure. FIG. 27 corresponds to FIG. 16, and it shows how the hose is pressed by the two locking devices 10 against the two parts of the retaining device 11. FIG. 28 corresponds to FIG. 17, and it shows how the pulling device 12 forms the first fold. FIG. 29 corresponds to FIG. 20, and it shows how the two parts of the retaining device 11 have been removed from the formed fold 4.

Figure 30:
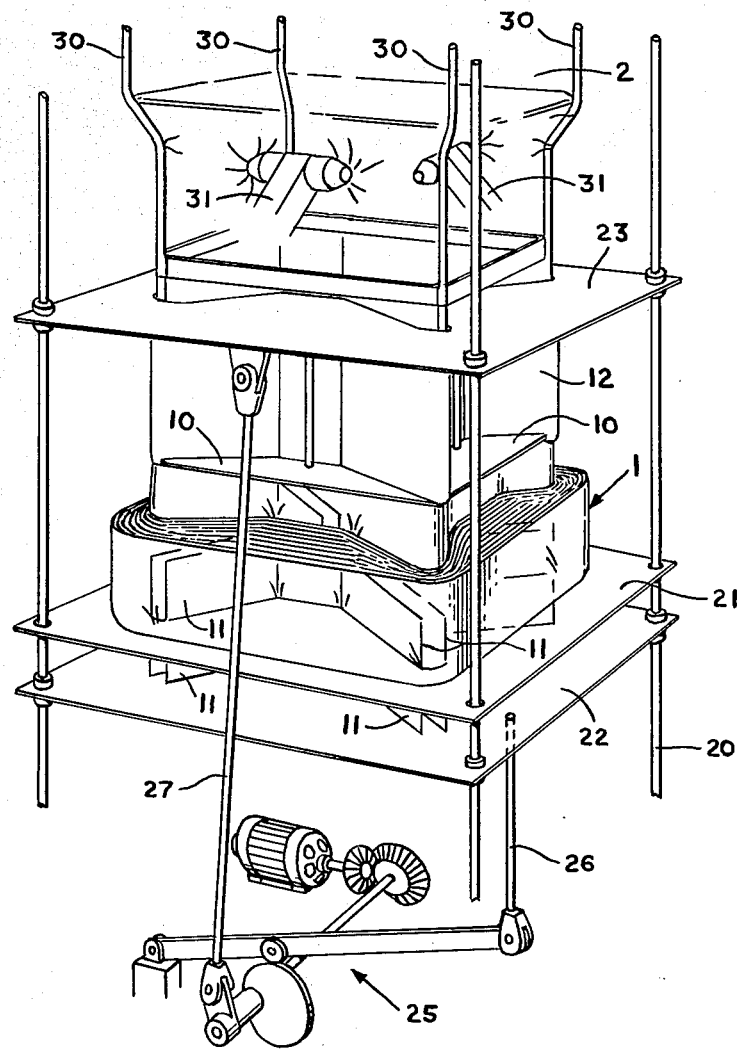
FIG. 30 shows an embodiment of a device for the production of the hose package.

FIG. 30 shows a device according to the invention for the manufacture of the hose package. The device comprises a frame 20, a machine table 21, a forming table 22, a pulling table 23, four spacing out devices for the hose 30, and four stretching devices 31, of which two are shown in the figure. The forming table 22 and the pulling table 23 are acted on by a driving device 25, for example, via two forming table bars 26 and two pulling table bars 27 respectively. In the figure is only shown one of the forming table bars and one of the pulling table bars.

On the forming table 22 the retaining device 11 is mounted, and on the pulling table 23 the pulling device 12 is fastened. The locking device 10 comprises four parts, of which two are shown in the figure. In the manufacture of the hose package, the hose 2 is fed via the spacing out device for the hose 30, and these space out the hose so that a tube is formed, in this example of a square cross section. This tube will later take up another shape with a cross section corresponding to the shape of the retaining device 11. In the figure, the retaining device has the shape of a four-point star, but other shapes can be employed. These other shapes can thus be adapted to the embodiments for hose packages as shown in the FIGS. 2–13, and the shapes of the retaining device which are necessary to form the hose package in question. The change in the cross section of the hose is obtained by adapting the spacing out devices for the hose 30 and the stretching device 31.

The driving device 25 together with a number of devices, e.g. of hydraulic or pneumatic type, which are not shown in the figure, bring about and co-ordinate the movements of the various parts in the machine so that the hose package is formed according to the principle which is described in connection with FIGS. 14–25. The magazine table 21 is firmly mounted on the frame 20. The driving device 25 acts on the forming table 22 and the pulling table 23 via the forming table bars 26 and the pulling table bars 27 respectively, in such a way that the table makes a translative movement to and fro at a right angle to the plane of the table. The retaining device 11 is arranged on the forming table 22 so that the various parts of the device perform a stepwise movement directed in the plane of the table, and adapted to the function, when the table is situated in the two turning positions. When the forming table 22 is in the turning position which is closest to the magazine table 21, the parts in the retaining device 11 take up a position, through stepwise movement, which facilitates retaining of the hose as described in connection with FIGS. 15 and 16. When the forming table is situated in the other turning position, the parts in the retaining device 11 will make another stepwise movement, but in the opposite direction, in order to facilitate a repetition of the earlier mentioned stepwise movement. The last-mentioned stepwise movement has also been described in connection with FIG. 21. The pulling device 12 is arranged on the pulling table 23. The locking device 10 is divided and arranged in such a way that each part can press the hose firmly against the respective parts in the retaining device 11 when the forming table 22 is in its turning position nearest the magazine table 21. The operation of the retaining device has been described more in detail in connection with FIGS. 14–25.

The operation of the device in connection with the formation of the hose package is described below. In the starting position, the forming table 22 is in its position nearest the magazine table 21, and the pulling table 23 in its position furthest from the magazine table. Further, the locking device 10 takes up the position where the hose can run freely over the retaining device 11. The hose is led via the spacing out devices for the hose 30 and the stretching device 31, so that it surrounds the retaining device 11 with the end of the hose. From the starting position the driving device then moves the locking device so that the hose is pushed against the retaining device 11 by the locking device 10, and then the pulling table 23 will move in the direction towards the magazine table 21, and the pulling device 12 will feed a predetermined length of the hose, which length is laid against the retaining device 11 so that a fold is formed. The locking device 10, the retaining device 11, and finally the pulling device 12 are removed from the formed fold 4 through the continuous movement of the pulling table 23 and the forming table 22. The movements of the locking device, retaining device, and pulling device thus follows the sequence of events which was shown in principle in FIGS. 14–25. When the forming table has reached the turning position which is furthest away from the magazine table 21, the parts of the retaining device 11 will then perform the stepwise movement mentioned, so that when the forming table returns to its other turning position the parts of the retaining device 11 are led inside the recently laid fold 4. When the forming table is again in the turning position and the retaining device is in a position at the center of the fold, the parts of the retaining device will again perform the stepwise movement so that the laid fold is moved in a radial direction outwards in order to permit another fold to be formed in the way described. Folds are thus formed successively so that the outer mantle surface 5 of the hose package is first formed, and the folding operation is continued until a sufficient number of folds have been formed, and the last fold will then make up the inner mantle surface 3 of the hose package. It is obvious that, with a modification of the device, the hose package can be formed through successive folding where the inner mantle surface is formed first and the last fold makes up the outer mantle surface.

The length of the hose, which by means of a device operating according to the invention, is embedded in the hose package, can be determined in various ways. Thus, the length of the stroke of the pulling device can be adjusted. By counting the number of strokes for the pulling device, the length of the embedded hose can thus be determined. According to another alternative, a measuring wheel can lie against the hose when this is pulled over the spacing devices for the hose 30. The registration of the number of revolutions of the mesuring wheel facilitates the determination of the length of the fed hose. One of the wheels on the stretching device 31 can even be used for this purpose.

Irrespective of which measuring method is used, the legnth of the embedded hose in each hose package can be regulated by means of a counting train which discontinues the embedding of the hose when a predetermined length of hose has been registered. The hose package formed is then separated from the hose which is on its way into the device, for instance by means of a heating wire.

Figure 4:
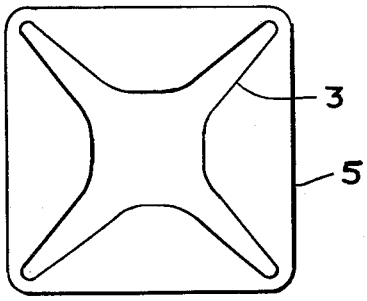
Figure 5:
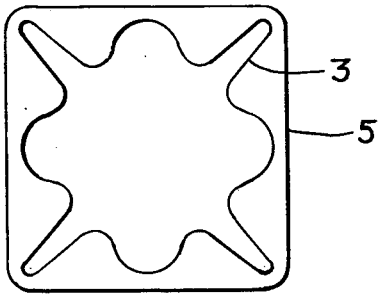
Figure 6:
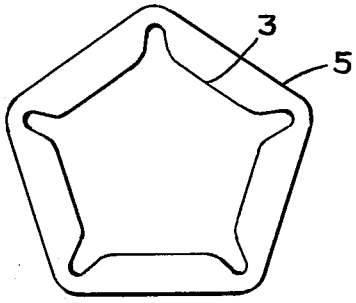
Figure 7:
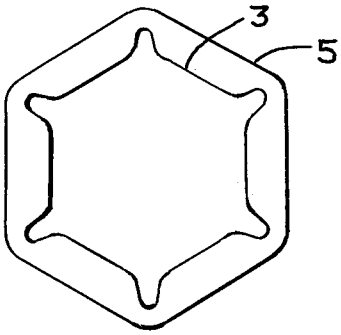
Figure 8:
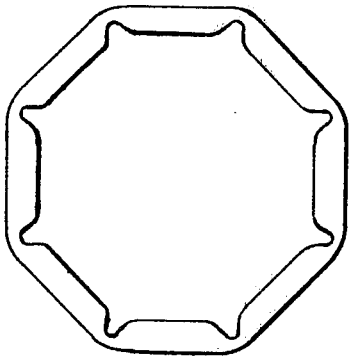
Figure 9:
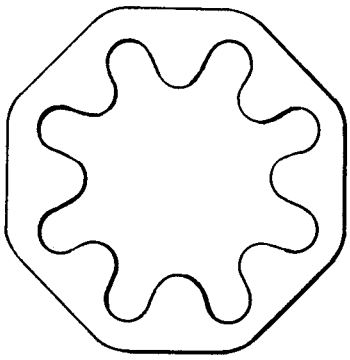
Figure 10:
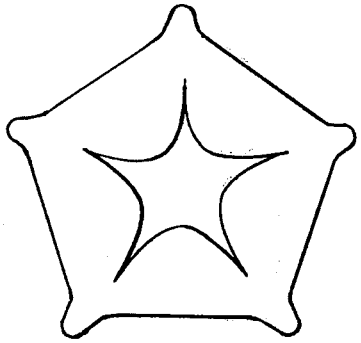
Figure 11:
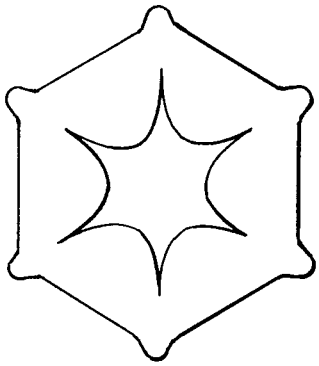
Figure 12:
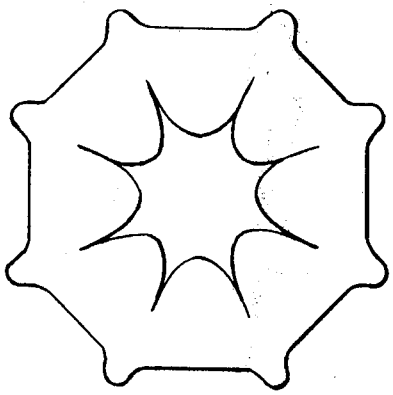
Figure 13:
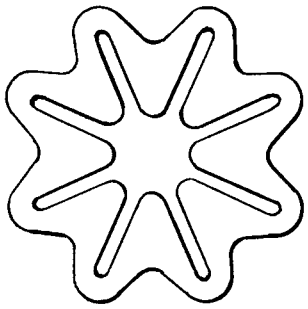
Figure 31:
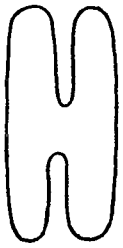
FIG. 31 shows a hose package with an embodiment according to FIG. 4 folded for transportation.

The hose package, described is a space-saving and efficient package for instance, of plastic hoses of both large and small diameter. Especially the embodiment which is shown in FIG. 4 opens the possibilities of folding together of the individual hose packages so that a minimum amount of transport space is required. As shown in FIG. 31, the hose package takes up the shape, in principle, of a rectangular box when the corners of the hose package are bent in pairs against each other.

I claim:

1. A method of folding a tubular length of hose material to form a package with superposed annular layers, said method comprising the steps of feeding a first length of tubular hose material longitudinally past a pulling device onto a retaining guide such that the tubular hose is held open and said first length extends annularly, said device being longitudinally and transversely movable and being in an initial position when the hose material is fed therepast, clamping the material to said guide, displacing said pulling device to pull a further length of tubular hose material and fold the same as an annular layer onto the first length of tubular material clamped to said guide, releasing the clamping of the material to said guide, withdrawing the retaining guide from between said first length of material and said annular layer and positioning the guide adjacent the outer surface of the annular layer, withdrawing the pulling device by longitudinally displacing the same in reverse direction to its initial position and repeating the above steps to form successive annular folds of material to constitute the superposed annular layers of the package.

2. A method as claimed in claim 1 wherein the pulling device has opposite sides and the retaining guide is positioned on a first side of the pulling device when the material is clamped to the retaining guide, said retainer guide upon withdrawal being laterally displaced to a position on the opposite side of the pulling device before being placed adjacent the folded material.

3. A method as claimed in claim 2 comprising laterally displacing the retaining guide after withdrawal of the pulling device to laterally displace the folded material, the lateral displacement of the retainer guide being of a magnitude to move the retainer guide to a position corresponding to placement of the retainer guide on said first side of the pulling device.

4. A method as claimed in claim 1 wherein the package has inner and outer annular surfaces and the successive folding of the material is effected from the outer surface of the package towards the inner surface of the package.

5. A method as claimed in claim 4 wherein the retaining guide and the pulling device form corners in the superposed annular folds of the material of the package such that the package has a polygonal outer configuration and a hollow interior configuration of star shape with a plurality of points corresponding to said corners and wherein the folds of the material are stretched over the points.

6. A method as claimed in claim 5 wherein the longitudinal lengths of material are formed into annular folds which are all of equal circumferential extent whereby the folds are progressively expanded from the inner surface to the outer surface of the package.

7. Apparatuus for folding a tubular length of hose material to form a package with superposed annular folds, said hose material having inner and outer surfaces, said apparatus comprising reciprocably movable pulling means having opposite sides and positioned to permit passage of one of the surfaces of the hose material in open annular formation on one side of the pulling means, retaining means movable in reciprocation in first and second mutually perpendicular directions adjacent the other of the surfaces of said openn annular material, means for moving said retaining means in a first direction of reciprocation from a first position on a first side of the pulling means to a second position on an opposite side of said pulling means, locking means for clamping the hose material against the retaining means in said first position , means for moving said locking means between a first position in which the hose material is clamped against the retainer means and a second position in which the hose material is released from the retainer means, and means for moving said pulling means from a first release position to a second operative position to form an annular fold in the hose material when the material is clamped by the locking means and retainer means.

8. Apparatus as claimed in claim 7 wherein said pulling means and retaining means successively overlap one another to form a succession of superposed annular folds.

9. Apparatus as claimed in claim 8 wherein said means which moves said retaining means acts to move said retaining means in a reciprocal stroke in the second direction of reciprocation in the course of reciprocal movement of said retaining means in going from said first to said second positions thereof.

10. Apparatus as claimed in claim 9 wherein said retaining means acts to displace the formed fold in traveling from the second position to the first position.

11. Apparatus as claimed in claim 9 wherein said second direction of reciprocation of the retaining means is parallel to the direction of reciprocation of the pulling means.

12. Apparatus as claimed in claim 7 comprising means for adjusting the stroke in reciprocation of said pulling means for adjusting the height of the folds of the material in the package.

13. Apparatus as claimed in claim 7 wherein said retaining means and pulling means are shaped to form corners in the annular folds of the material of the package, such that the package has a polygonal outer configuration and a hollow interior configuration of star shape with a plurality of points aligned with said corners, said annular folds of material being stretched by said pulling means over the retaining means at said points.

* * * * *

UNITED STATES PATENT AND TRADEMARK OFFICE

CERTIFICATE OF CORRECTION

PATENT NO. : 4,265,439

DATED : May 5, 1981

INVENTOR(S) : Sture Sundberg

It is certified that error appears in the above-identified patent and that said Letters Patent are hereby corrected as shown below:

On the title page, Item [30] should read:

--- March 17, 1976 Sweden 7603332 -- --

Signed and Sealed this

*Eighth* Day of *September 1981*

[SEAL]

*Attest:*

GERALD J. MOSSINGHOFF

*Attesting Officer*

*Commissioner of Patents and Trademarks*